United States Patent [19]

Pfefferle

[11] 3,975,900

[45] Aug. 24, 1976

[54] METHOD AND APPARATUS FOR TURBINE SYSTEM COMBUSTOR TEMPERATURE

[75] Inventor: William C. Pfefferle, Middletown, N.J.

[73] Assignee: Engelhard Minerals & Chemicals Corporation, Murray Hill, N.J.

[22] Filed: Oct. 30, 1974

[21] Appl. No.: 519,288

Related U.S. Application Data

[63] Continuation-in-part of Ser. No. 227,420, Feb. 18, 1972, abandoned.

[52] U.S. Cl. ..... 60/39.03; 60/39.23; 60/39.27; 60/39.82 C

[51] Int. Cl.[2] ..... F02C 9/04; F02C 9/14

[58] Field of Search ..... 60/39.23, 39.26, 60/39.27, 39.28 R, 39.02, 39.03, 39.04, 39.29, 39.82 C; 431/7

[56] References Cited

UNITED STATES PATENTS

| | | | |
|---|---|---|---|
| 2,807,933 | 10/1957 | Martin | 60/39.23 |
| 2,812,637 | 11/1957 | Fox | 60/39.23 |
| 3,394,265 | 7/1968 | Hendrickson | 60/39.29 |
| 3,584,459 | 1/1971 | Amann | 60/39.23 |
| 3,691,761 | 9/1972 | Jackson et al. | 60/39.23 |
| 3,691,762 | 9/1972 | Ryberg et al. | 60/39.23 |
| 3,765,171 | 10/1973 | Hagen et al. | 60/39.23 |
| 3,820,320 | 6/1974 | Schirmer et al. | 60/39.74 R |

FOREIGN PATENTS OR APPLICATIONS

| | | | |
|---|---|---|---|
| 842,780 | 7/1960 | United Kingdom | 60/39.82 C |
| 656,888 | 9/1951 | United Kingdom | 60/39.27 |
| 817,931 | 8/1959 | United Kingdom | 60/39.27 |

OTHER PUBLICATIONS

Smith, I. E., "Combustion in Advanced Gas Turbine Systems", Apr., 1967, pp. 14–15.

*Primary Examiner*—William L. Freeh
*Assistant Examiner*—Robert E. Garrett

[57] ABSTRACT

A method and apparatus for operating a gas turbine system are disclosed utilizing an adiabatic combustion process, employing combustion of a pre-mixed carbonaceous fuel-air admixture in a combustion zone. The combustion and the combustion zone are maintained at an approximately constant temperature by selective control of the fuel-to-air ratio over a period of turbine operation during which the fuel demand or the combustion air temperature varies. Such combustion is conducted in the presence of an oxidation catalyst and the combustion zone including the catalyst is maintained at an approximately constant temperature. In a mode of operation which is preferred when conditions permit, such temperature is substantially above the instantaneous auto-ignition temperature of the fuel-air admixture but below a temperature that would result in any substantial formation of oxides of nitrogen. The resulting effluent is characterized by high thermal energy useful for generating power and may be low in atmospheric pollutants, including oxides of nitrogen.

21 Claims, 4 Drawing Figures

METHOD AND APPARATUS FOR TURBINE SYSTEM COMBUSTOR TEMPERATURE

Figure 1:
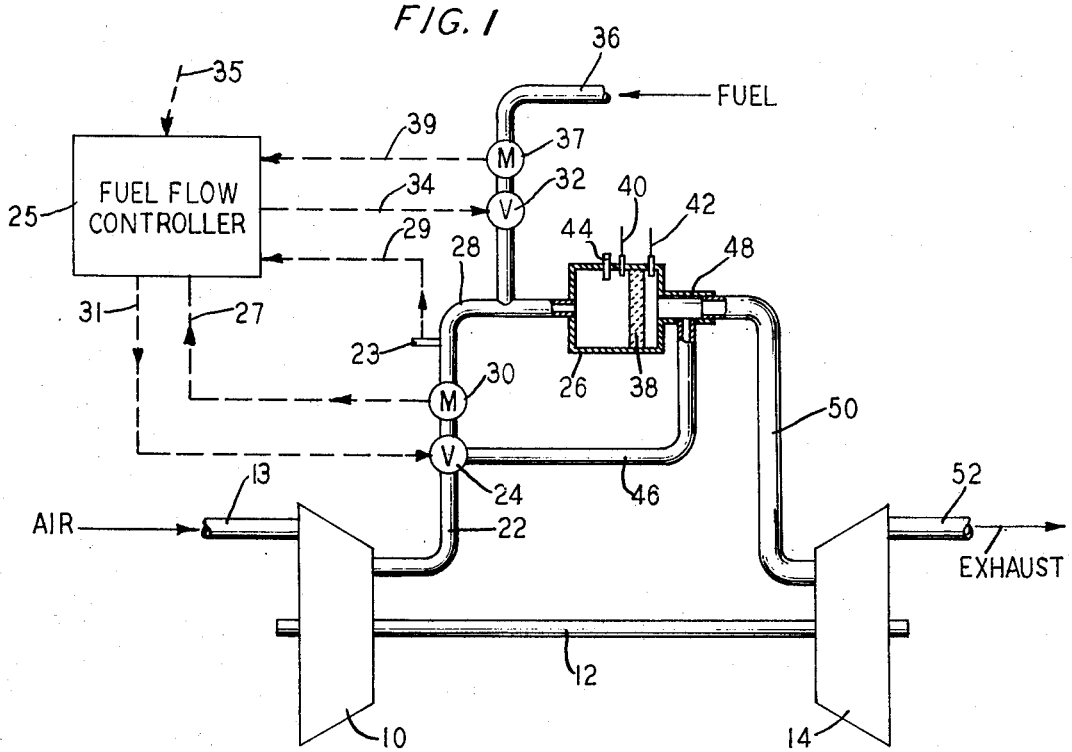

This application is a continuation-in-part of co-pending application Ser. No. 227,420 filed on Feb. 18, 1972, now abandoned.

This invention relates to a method of operating a gas turbine, and to a turbine system comprising appropriate apparatus, for utilizing a catalyst to obtain sustained adiabatic combustion of carbonaceous fuels in intimate admixture with air. The combustion is conducted in the presence of the catalyst by providing a selectively controlled fuel-to-air volume ratio to achieve an essentially constant combustion temperature within the range of about 1200° to about 3200°F. The fuel-air mixture is passed into the presence of a solid oxidation catalyst for combustion at a preselected temperature which is maintained at an approximately constant level. Subsequently, additional, selectively controlled air can be combined with the products or effluent from the combustion of the fuel-air admixture. The combustion effluent is characterized by high thermal energy and typically has low nitrogen oxides content. When conditions permit, the preselected combustion temperature preferably is chosen to be substantially above the instantaneous auto-ignition temperature of the fuel-air admixture but below a temperature that would result in the substantial formation of oxides of nitrogen. However, the available fuel or combustion air may preclude operation above the instantaneous auto-ignition temperature. The advantages of operation at an approximately constant temperature may be realized at any combustion temperature, and such operation permits the handling of large transient loads in a catalytic combustion system operating under mass transfer limited conditions. The method and apparatus of this invention thus provide for highly efficient turbine operation and quick response to changes in operation of the system with relatively little atmospheric pollution.

Adiabatic combustion systems, from a practical standpoint, have relatively low heat losses, thus substantially all of the heat released from the combustion zone of such systems appears in the effluent gases as thermal energy for producing power. In general, conventional adiabatic, thermal combustion systems operate by contacting fuel and air in inflammable proportions with an ignition source to ignite the mixture which then will continue to burn. Frequently the fuel and air are present in stoichiometric proportions. These conventional systems usually operate at such high temperatures in the combustion zone as to form nitrogen oxides or $NO_x$. Such systems will not operate at all with highly vitiated air such as nitric acid plant tail gas.

Many thermal combustors employed in turbine systems utilize separate injection of air and fuel into the combustion zone without premixing. Such combustors frequently have a fixed combustor air inlet geometry, so that a predetermined fraction of the inlet air enters the primary or combustion zone and the balance enters the secondary or dilution zone. This allows for variation of the turbine power by adjusting the fuel rate to the combustor and thus varying the temperature of the effluent to the turbine inlet and consequently the turbine power.

Conventional combustors frequently produce high amounts of pollutants because of inefficient combustion. In the type of combustor previously described the fuel delivery system can normally be designed for optimum fuel delivery over only a small portion of the operating range of the combustor. Such narrow limits of most efficient operation tend to produce high levels of CO, unburned hydrocarbons, soot and the like in certain operating modes. For example, at idle conditions the fuel flow may be so low as to result in improper atomization because of low fuel pressure at the fuel nozzle; further, the global air to fuel ratio tends to be relatively high in the combustion zone whenever a decrease in power level occurs because only the fuel flow is decreased while the air flow remains constant for at least a short period of time thereafter. This excess air results in premature quenching which produces CO, unburned hydrocarbons, and the like. For operation above the optimum design limits, the combustion zone tends to operate excessively fuel rich at least in certain random regions, with the result that unburned fuel droplets are coked to make soot and quenched in the dilution zone with high emissions of CO, soot, and unburned hydrocarbons, for example, many commercial aircraft on takeoff operate at such conditions.

Attempts have been made to control the fuel-to-air ratio in conventional combustors. Such attempts, however, have not satisfactorily dealt with the problem of sustained low emission combustion which is responsive to variations in load on the engine and other operating conditions. In fixed geometry conventional combustors which burn fuel in air at approximately the stoichiometric ratio, the hole pattern of the combustor liner is ordinarily designed for best operation of the primary or combustion zone, at nearly full load. As previously discussed, with such apparatus the overall fuel-air ratio decreases at light load or at idle resulting in a leaner mixture in the combustion zone, which can lead to reduced combustion efficiency and increased exhaust emissions. It has been proposed to overcome this problem by using variable combustor geometry to operate the primary or combustion zone at a constant fuel-air ratio, i.e., close to stoichiometric at all turbine operating conditions. Although this does solve the hydrocarbon and carbon monoxide problem, it does not even address the $NO_x$ problem. Formation of $NO_x$ occurs at relatively high temperatures, which inevitably are reached in adiabatic combustion systems with near-stoichiometric fuel-air ratios. Thus simply changing the combustor geometry to maintain near-stoichiometric ratios will not avoid $NO_x$ formation. Further, at a fixed fuel-air ratio the combustion temperature will vary according to variations in the temperature of the air at the inlet to the combustor so that combustion temperature is not fixed.

Flammable mixtures of most fuels, for complete combustion, normally burn at relatively high temperatures, i.e., above about 3300°F which inherently results in the formation of substantial amounts of $NO_x$. In the case of conventional gas turbine thermal combustors, formation of $NO_x$ has been reduced by limiting the residence time of the combustion products in the combustion zone. However, due to the large quantities of gases being handled, undesirable amounts of $NO_x$ are produced. Many conventional combustors, by injecting the fuel into the combustor in droplet form and separately from the air used for combustion present serious drawbacks to low pollution operation. Such a system substantially precludes very lean sustained combustion. Consequently, the combustion temperature of the droplet boundaries will frequently be approximately the theoretical adiabatic flame temperature of a stoichiometric mixture of the fuel and air; this temperature will be substantially over 3300°F, and typically in excess of 4000°F. Thus even though the overall temperature in the combustor may be quite low and not high enough to form $NO_x$, the temperature near the droplet surface is typically in excess of that required to form $NO_x$. $NO_x$ thus forms and is present in the combustor effluent.

In copending application Ser. No. 358,411, filed May 8, 1973, and incorporated herein by reference, there is disclosed the discovery of catalytically-supported, thermal combustion. According to this method, carbonaceous fuels can be combusted very efficiently at temperatures between about 1700° and 3200°F, for example, without the formation of substantial amounts of carbon monoxide or nitrogen oxides by a process designated catalytically-supported, thermal combustion. To summarize briefly what is discussed in greater detail in application Ser. No. 358,411, in conventional thermal combustion of carbonaceous fuels, a flammable mixture of fuel and air or fuel, air, and inert gases is contacted with an ignition source (e.g., a spark) to ignite the mixture. Once ignited, the mixture continues to burn without further support from the ignition source. Flammable mixtures of carbonaceous fuels normally burn at relatively high temperatures (i.e., normally well above 3300°F). At these temperatures substantial amounts of nitrogen oxides inevitably form if nitrogen is present, as is always the case when air is the source of oxygen for the combustion reaction. Mixtures of fuel and air or fuel, air and inert gases which would theoretically burn at temperatures below about 3300°F are too fuel-lean to support a stable flame and therefore cannot be satisfactorily burned in a conventional thermal combustion system.

In conventional catalytic combustion, on the other hand, the fuel is burned at relatively low temperatures (typically in the range of from a few hundred degrees Fahrenheit to approximately 1500°F) and little or no nitrogen oxides are formed. Although conventional catalytic combustion proceeds relatively slowly so that for most applications impractically large amounts of catalyst would be required to produce large quantities of oxidation gases for certain important applications, e.g., ethylene oxide and nitric acid plant tail gas, combustion systems, conventional mass transfer limited catalytic combustion reactors are widely used.

As discussed in application Ser. No. 358,411, conventional catalytic combustion reactions follow the course of the graph shown in FIG. 3 of the accompanying drawings, to the extent of regions A through C in that figure. This graph is a plot of reaction rate as a function of temperature for a given catalyst and set of reaction conditions. At relatively low temperatures (i.e., in region A of FIG. 3) the catalytic reaction rate increases exponentially with temperature. As the temperature is raised further, the reaction rate enters a transition zone (region B in the graph of FIG. 3) in which the rate at which the fuel and oxygen are being transferred to the catalytic surface begins to limit further increases in the reaction rate. As the temperature is raised still further, the reaction rate enters a so-called mass transfer limited zone (region C in the graph of FIG. 3) in which the reactants cannot be transferred to the catalytic surface fast enough to keep up with the catalytic surface reaction, and the reaction rate levels off regardless of further temperature increases. In the mass transfer limited zone, the reaction rate cannot be increased by increasing the activity of the catalyst because catalytic activity is not determinative of the reaction rate. Prior to the invention described in application Ser. No. 358,411, the only apparent way to increase the reaction rate in the mass transfer limited zone was to increase the mass transfer rate. However, this requires an increase in the pressure drop across the catalyst and consequently a substantial loss of energy. Sufficient pressure drop may not even be available to provide the desired reaction rate. Of course, more mass transfer can be effected, and hence more energy can always be produced, by increasing the amount of catalyst surface. In many applications, however, this results in catalyst configurations of such size and complexity that the cost is prohibitive and the body of the catalyst is unwieldy. For example, in the case of gas turbine engines, the catalytic reactor might very well be larger than the engine itself.

As described in application Ser. No. 358,411, it has been discovered that it is possible to achieve essentially adiabatic combustion in the presence of a catalyst at a reaction rate many times greater than the mass transfer limited rate. In particular, it has been found that if the operating temperature of the catalyst is increased substantially into the mass transfer limited zone, the reaction rate again begins to increase rapidly with temperature (region D in the graph of FIG. 3). This is in apparent contradiction of the laws of mass transfer kinetics in catalytic reactions. The phenomenon may be explained by the fact that the temperature of the catalyst surface and the gas layer near the catalyst surface are above the instantaneous auto-ignition temperature of the mixture of fuel, air, and any inert gases (defined herein and in application Ser. No. 358,411 to mean the temperature at which the ignition lag of the mixture entering the catalyst is negligible relative to the residence time in the combustion zone of the mixture undergoing combustion) and at a temperature at which thermal combustion occurs at a rate higher than the catalytic combustion rate. The fuel molecules entering this layer burn spontaneously without transport to the catalyst surface. As combustion progresses and the temperature increases, it is believed that the layer in which thermal combustion occurs becomes deeper. Ultimately, substantially all of the gas in the catalytic region is raised to a temperature at which thermal combustion occurs in virtually the entire gas stream rather than just near the surface of the catalyst. Once this stage is reached within the catalyst, the thermal reaction appears to continue even without further contact of the gas with the catalyst. As a result the range of turbine applications for combustion in the presence of a catalyst is greatly enlarged.

The foregoing is offered as a possible explanation and is not to be construed as in any way limiting the combustion of fuel-air admixtures in the presence of a catalyst when carried out along with other specified procedures as a part of the method of the present invention.

Broadly, in the present invention a gas turbine is operated by combusting a carbonaceous fuel over a period of turbine operation during which the amounts of the fuel and combustion air are varied or the temperature of the combustion air varies. Intake air is compressed and at least a portion of the compressed air is intimately admixed with a carbonaceous fuel. The resulting admixture is then passed to a temperature-controlled catalyst-containing combustion or primary zone, where it is combusted at an approximately constant temperature of at least about 10000°F; combustion temperatures lower than 1000°–1200°F ordinarily will not provide turbine inlet temperatures high enough to give desirable amounts of power. When operating in the above-discussed region of higher temperatures where reaction rate is not limited by mass transfer, catalyst temperatures should be within the range of about 1700° to about 3200°F. The fuel-to-air volume ratio is adjusted and controlled as a function of the temperature of the gas entering the combustion zone so that the combustion temperature or theoretical adiabatic flame temperature of the mixture remains about constant over a wide range of fuel inputs. The effluent from the combustion zone is combined in a secondary zone with at least a portion and preferably most of the remaining compressed air charged to the turbine system.

The power obtained from the gas turbine can thus be controlled without changing the temperature in the combustion zone by adjusting the overall volume of fuel-air mixture to the combustion zone and the volume of additional or bypass air or gas combined with the combustion effluent. These adjustments regulate the temperature of the gas entering the turbine and thus the power produced thereby. Since the temperature of the combustor effluent-bypass air mixture is primarily dependent on the temperature and relative amounts of combustor effluent and bypass air and since the combustion temperature remains relatively constant, it is possible to obtain a quick response of the gas turbine system to different power requirements by varying the amount of additional or bypass air combined with the combustion effluent. This avoids the typical shortcomings of any catalytic system in which a change in operating temperature requires a change in catalyst temperature which change delays the response of the effluent temperature to a change in fuel input. Such a delay is especially objectionable in turbines for automobiles where nearly instantaneous response is desired. Further, even at low turbine inlet temperatures, low combustion temperatures can be avoided. Thus the combustor need not operate at low temperatures which might impair performance and result in an effluent having a high content of carbon monoxide and hydrocarbons. Similarly, avoidance of combustion temperatures significantly in excess of about 3200°F avoids the formation of excessive amounts of nitrogen oxides during combustion.

More specifically in this invention intake air is compressed by a compressor turbine, and the compressed air is then preferably apportioned into at least two parts, one part of which is intimately admixed with a carbonaceous fuel and introduced into a combustion zone to be combusted, and a second part of which is combined with the effluent from such combustion. The relative amount of air in each part or portion is adjustable and proportionately interdependent.

The fuel-air admixture is maintained at about a constant theoretical adiabatic flame temperature by measurement of various parameters and delivery of interdependent amounts of fuel and air which amounts depend on these parameters by employing any convenient means. For instance, air flow metering and temperature sensing means, coupled with a valve or separating means to regulate the air flow to the combustion zone in relation to the fuel flow to the combustion zone, e.g., a venturi meter or like device in combination with a thermocouple and an air flow control valve, can be used to determine the amount of air to be admixed with the fuel for a given inlet air temperature. A compressor speed indicator together with a valve position indicator on the air flow valve can alternatively be used in place of the venturi meter. The fuel flow control valve is regulated by a fuel flow controller, based on power requirements of the turbine. The flow of air to the combustor is in turn related to the flow of fuel to the combustor as a function of inlet air temperature to maintain a pre-selected combustion temperature. The flow and temperature sensors transmit signals related to the volume and temperature of the air to the fuel flow controller. In response to these signals, the fuel flow controller adjusts the air flow control valve to provide a selected amount of air to pass to the system to be admixed with the fuel. Thus when the amount of fuel passing to the combustion zone is varied, the amount of air to be admixed with the fuel is proportionately varied to maintain a pre-selected essentially constant temperature in the combustion zone. This operation can, of course, designed so that the amount of fuel is responsive to the amount of air at a given temperature passed to the combustion zone.

The ratio of fuel to air in the admixture introduced into the combustion zone is ultimately determined by the desired operating temperature of the combustion zone. The operating temperature is determined by the theoretical adiabatic flame temperature of the fuel-air admixture passed to the combustor and thus is dependent on the initial temperature of the air as well as the amount of fuel contained therein.

In the operation of any engine various changes in load occur. For example, increases or decreases in output speed of a turbine may be required thus changing the amount of fuel needed. Further, even at constant speed, load changes are encountered. In certain turbine applications, for example, automobiles, increases or decreases in turbine power often result in an increase or decrease in compressor speed and respectively an increase or decrease in the compression and temperature of the air supplied to the system by the compressor. The theoretical adiabatic flame temperature of an admixture having a given fuel-to-air volume ratio will vary directly with the temperature of the air in the admixture. Thus, for example, as power requirements of the turbine are increased, a number of interrelated control changes must take place; the air charged to the system will be at a higher temperature which, unless compensated for, would increase the adiabatic flame temperature of a given fuel-air mixture. Further, a power increase implies a fuel flow increase; therefore, the portion of the total compressed air which is directed to the combustor must increase to maintain the theoretical adiabatic flame temperature approximately constant. The portion of the total compressed air directed to the bypass will be decreased to allow the temperature of the combined effluent gas-additional air admixture to increase. The relative amounts of each air stream, that is, the air introduced to the combustor and the air directed to the bypass are varied in an inverse manner. These interdependent changes maintain the combustor at an approximately constant temperature by controlling the fuel-air admixture introduced into the combustor to have an approximately constant theoretical adiabatic flame temperature.

The combustion effluent is preferably combined with additional, cooler air to quench the effluent and provide a motive fluid for the gas turbine at a desired temperature. The additional air can be at any convenient temperature, for instance, at about the temperature at which the air leaves the compressor, or it can be at a somewhat lower or higher temperature achieved, for example, by heat exchange with the exhaust gases from the turbine. The compressed air also can be heated to some extend through use as coolant gas for the walls of the combustion chamber as required to prevent overheating of the walls. Conveniently, the additional air is at a temperature between about 100° and 2000°F., and preferably about 500° to 1500°F. Thus the greater the amount of cooler additional air combined with the combustion effluent, the lower the temperature of the combined gases, and hence the less the power obtainable from the combined gases when used as a motive fluid in a turbine system. Similarly, if the amount of additional air employed is decreased, the power output from the turbine is increased. The temperature of the combined gases passed to the turbine inlet is generally about 800°F to 2500°F, and preferably, for increased turbine efficiency, about 1100°F to 2700°F. Another means for increasing the energy of the combined combustor effluent-bypass air in response to increased amounts of fuel is to increase proportionately both the amount of air to the combustion zone and the amount of additional air to be combined with the combustion effluent. This can be accomplished by the use of a suitable air flow control device, such as a butterfly valve or a lourvered shutter valve or the like, which can regulate the amount of air entering the compressor in relation to the amount of fuel delivered. The combustion effluent will remain at about a constant temperature, and the temperature of the combined gases will remain about the same, because the additional amount of combustion effluent is quenched with a proportionally increased amount of additional air. Since a greater mass of combined gases is produced, the resultant effect is that more power is available to the turbine.

In selected applications, for example turbines with high temperature capabilities, the additional air can be eliminated entirely. In such applications the turbine inlet temperature is constant and is essentially the combustion temperature. In such applications, fuel advantageously can be mixed with air at the inlet to the air compressor or even within the compressor itself.

The methods of control utilizing compressor air inlet regulation means is advantageous as the temperature of the combined gas at the turbine inlet will remain constant, thus protecting the turbine against thermal shock and permitting the turbine to operate at a higher efficiency to both low and high loads. The methods outlined employing an intake air regulation means on the air compressor are especially advantageous with turbines which will operate at combustion effluent temperatures, since bypass air then advantageously can be eliminated and control achieved by regulation of the amount of air entering the turbine in response to the fuel, thus taking full advantage of high temperature operation. In certain cases intake air regulation means on the compressor can be combined with an air regulation valve or air separating means in the system downstream of the air compressor to achieve more rapid response and a greater range of power.

A reduction of the power output of a turbine in the system of this invention can be effected in a manner analogous to that previously described by decreasing the total amount of air available or by decreasing the amount of air to the combustion zone while increasing the amount of additional air to be combined with the combustion effluent or by a combination of these changes.

It is readily seen that control of the power output of a turbine as employed in this invention can be achieved by any of several disclosed means or their combination.

In carrying out the method of the invention, combustion is achieved by contacting an intimate admixture of air and carbonaceous fuel with a substantially rigid solid oxidation catalyst. At least a portion of the available fuel is combusted under essentially adiabatic conditions. Essentially adiabatic combustion means in this case that the operating temperature of the catalyst differs by no more than about 300°F, and more typically by no more than about 150°F, from the adiabatic flame temperature of the mixture, due to heat losses from the catalyst.

Such combustion occurs at a substantially lower temperature than in conventional adiabatic thermal combustion, and therefore it is possible to operate without formation of significant amounts of $NO_x$. Further, the maintenance of an approximately constant catalytic combustion temperature protects the catalyst from physical degradation caused by thermal cycling. As explained herein, such combustion in the presence of a solid catalyst need not be limited by mass transfer as in the case of conventional catalytic combustion, and at the specified operating temperatures the reaction rate then is substantially increased beyond the mass transfer limitation, e.g., at least about five times greater than the mass transfer limited rate. Reaction rates of up to about 100 or more times the mass transfer limited rate may be attainable. Such high reaction rates permit high fuel space velocities which normally are not obtainable in conventional catalytic reactions. I can employ, for instance, at least an amount of fuel equivalent in heating value to about 300 pounds of propane per hour per cubic foot of catalyst, and this amount may be at least several times greater, for instance, an amount of fuel equivalent in heating value to at least about 1000 pounds of propane per hour per cubic foot of catalyst. There is, moreover, no necessity for maintaining fuel-to-air ratios in the inflammable range, and consequently loss of combustion (flame-out) due to variations in the fuel-to-air ratio is not the problem it is in conventional combustors.

As previously stated, the adiabatic flame temperature of fuel-air admixtures at any set of conditions (e.g., initial temperature and, to a less extent, pressure) is established by the ratio of fuel to air. The admixtures utilized in the above-described combustion in the presence of a catalyst are generally within the inflammable range, or are fuel-lean outside of the inflammable range, but there may be instances of a fuel-air admixture having no clearly defined inflammable range but nevertheless having a theoretical adiabatic flame temperature within the operating conditions of the invention. The proportions of the fuel and air charged to the combustion zone are typically such that there is a stoichiometric excess of oxygen based on complete conversion of the fuel to carbon dioxide and water. Preferably, the free oxygen content is at least about 1.5 times the stoichiometric amount needed for complete combustion of the fuel.

Although the invention is described herein with particularity to air as the nonfuel component, it is well understood that oxygen is the required element to support proper combustion. Where desired, the oxygen content of the nonfuel component can be varied and the term "air" is used herein to refer to the nonfuel components of the admixtures. The fuel-air admixture fed to the combustion zone may have as low as 10 percent free oxygen by volume or less, which may occur, for example, upon utilization, as a source of oxygen, of a waste stream wherein a portion of this oxygen has been reacted.

The carbonaceous fuels employed may be gaseous or liquid at normal temperature and pressure. Suitable hydrocarbon fuels may include, for example, low molecular weight aliphatic hydrocarbons such as methane, ethane, propane, butane, pentane; gasoline; aromatic hydrocarbons such as benzene, toluene, ethylbenzene, xylene; naphtha; diesel fuel; jet fuel; other middle distillate fuels; hydrotreated heavier fuels; and the like. Among the other useful carbonaceous fuels are carbon monoxide; alcohols such as methanol, ethanol, isopropanol; ethers such as diethylether and aromatic ethers such as ethylphenyl ether. In burning diluted fuels containing inerts, for example, low BTU coal gas, fuel-air admixtures with adiabatic flame temperatures within the range specified herein may be either fuel rich or fuel lean. Where fuel rich mixtures are utilized, additional air or fuel-air admixture may be added to the effluent from the zone containing the catalyst to provide an overall excess of air for complete combustion of fuel components to carbon dioxide and water. It will be noted that thermal reactions may continue beyond the catalyst-containing zone, provided the effluent temperature is substantially above the instantaneous autoignition temperature.

In a fuel-rich operation, it is often desirable to employ a fuel-air admixture having at least about 25 percent and preferably at least about 35 percent by weight of the amount of free oxygen necessary to completely oxidize the fuel to carbon dioxide and water. In fuel rich operation the effluent from the combustion zone may, therefore, be relatively high in carbon monoxide and hydrocarbon content. The partially oxidized effluent can be admixed with at least a sufficient amount of air to completely combust the effluent to carbon dioxide and water. The mixture of the partially combusted effluent and air can be thermally combusted in a thermal combustion zone adjacent to the outlet of the primary combustion zone. If desired, the thermal oxidation may partially occur in the turbine blade area. It is also possible to use the partially combusted effluent to power a first turbine and then combust the emanating exhaust gases, either thermally or catalytically, with an additional amount of air to reheat the gases to provide power in a second turbine.

The velocity of the fuel-air admixture upstream of the combustion zone is preferably in excess of the maximum flame propagating velocity at or upstream of the catalyst inlet to avoid flashback that results in high temperature stoichiometric combustion and thus the formation of $NO_x$. Preferably, this velocity is maintained adjacent to the catalyst inlet. Suitable linear gas velocities are usually above about three feet per second, but it should be understood that considerably higher velocities may be required depending upon such factors as temperature, pressure, and composition.

The catalyst generally operates at a temperature approximately the theoretical adiabatic flame temperature of the fuel-air admixture charged to the combustion zone. The entire catalyst may not be at these temperatures, but preferably a major portion, or essentially all, of the catalyst surface is at such operating temperatures. These temperatures are usually in the range of about 1200° to 3200°F, preferably about 2000°F to about 3000°F. At temperatures below about 1500°F the combustion proceeds conventionally as a heterogeneous, mass transfer limited oxidation reaction at the surface of the catalyst. At temperatures in excess of about 1700°F the reaction rate no longer is limited by mass transfer to the surface of the catalyst, as discussed hereinabove. The temperature of the zone containing the catalyst is controlled by controlling the composition of the fuel-air admixture, and hence the adiabatic flame temperature, as well as the uniformity of the mixture. Relatively higher energy fuels can be admixed with larger amounts of air in order to maintain the desired temperature in a combustion zone. At the higher end of the temperature range, shorter residence times of the gas in the combustion zone appear to be desirable in order to lessen the chance of forming $NO_x$. The residence time is governed largely by temperature, pressure, and space throughput, and generally is measured in milliseconds. The residence time of the gases in the zone containing the catalyst and in any subsequent thermal combustion zone may be below about 0.1 second, preferably below about 0.05 second. The gas space velocity may often be, for example, in the range of about 0.5 to 10 or more million cubic feet of total gas (standard temperature and pressure) per cubic foot of total combustion zone per hour. For a stationary turbine burning diesel fuel, typical residence times could be about 30 milliseconds or less; whereas in an automotive turbine engine burning gasoline, the typical residence time may be about 5 milliseconds or less. The total residence time in the combustion system should be sufficient to provide essentially complete combustion of the fuel, but not so long as to result in the formation of $NO_x$.

Nitrogen oxides found in the effluent may have been introduced to the system from the air supply or even from the fuel as an impurity. Combustion occurs, however, without the substantial formation of $NO_x$ in the turbine-operating system of the preferred embodiments of the present invention. Typically, the combustion effluent will contain less than about 15, and often less than about 10, parts per million by volume of $NO_x$ above the amount fed to the combustion system. Values of $NO_x$ may be lower than those present in the incoming air. In addition, the effluent from combustion of a nitrogen-free carbonaceous fuel may typically contain less than about 2 parts per million by volume of $NO_x$. It is of further significance that the effluent typically may contain less than about 10 parts per million by volume hydrocarbons, and frequently less than about 300 parts per million by volume carbon monoxide, and less than about 20 parts per million $NO_x$. Effluents this low in pollutants are most acceptable and are far below any requirements of the Federal Emission Standards established by the Environmental Protection Agency for 1976 for automobile emissions.

In order to improve the thermal efficiency of the over-all system, the air, and even the fuel, may be heated before being passed into the combustion zone containing the catalyst. The fuel-air admixture for a nonregenerative turbine at full speed typically may have a temperature of at least about 400°F, and for a regenerative turbine typically of about 1000°F, before contact with the catalyst. Usually there is no need to preheat the fuel-air admixture above about 1500°F.

The solid or rigid oxidation catalysts useful for the invention may include any of a number of catalysts used for the oxidation of fuels. Typically, the catalyst comprises a carrier and an active component with or without the addition of other activators or promoters. These catalysts may include a wide variety of materials as well as configurations or structures. For example, the catalyst may comprise a packed bed of pellets, saddles, rings, or the like. Preferably, the catalyst comprises a monolithic or unitary structure comprising a ceramic substrate or carrier impregnated with one or more catalytically-active components. Monoliths of this type may be shaped ceramic fiber usually in cylindrical form or thin-walled honeycomb-type structures. The flow channels in the honeycomb structures are usually parallel and may be of any desired cross-section such as triangular or hexangular. The number of channels per square inch may vary greatly depending upon the particular application, and monolithic honeycombs are commercially available having anywhere from about 50 to 2000 channels per square inch. The substrate or carrier portion of the honeycomb desirably is porous, but may be essentially non-porous, and catalytically is relatively inert. The substrate may be provided with a porous film or coating, typically of alumina, which is impregnated with one or more catalytically-active components. Structures of this type are particularly desirable because the pressure drop of gases passing through them is relatively low, and generally they are self-supporting. The catalytically-active component of the catalyst is generally metal either in the elemental state or in the combined state such as an oxide. Examples of such metals are zirconium, vanadium, chromium, manganese, copper, platinum, palladium, iridium, rhodium, ruthenium, cerium, cobalt, nickel, and iron. The particular catalyst and amount employed may depend primarily upon the design of the combustion system, the type of fuel used, and operating temperature. The pressure drop of the gases passing through the catalyst, for example, may be below about 10 psi, preferably below about 3 psi, or less than about 10 percent of the total pressure.

Figure 2:
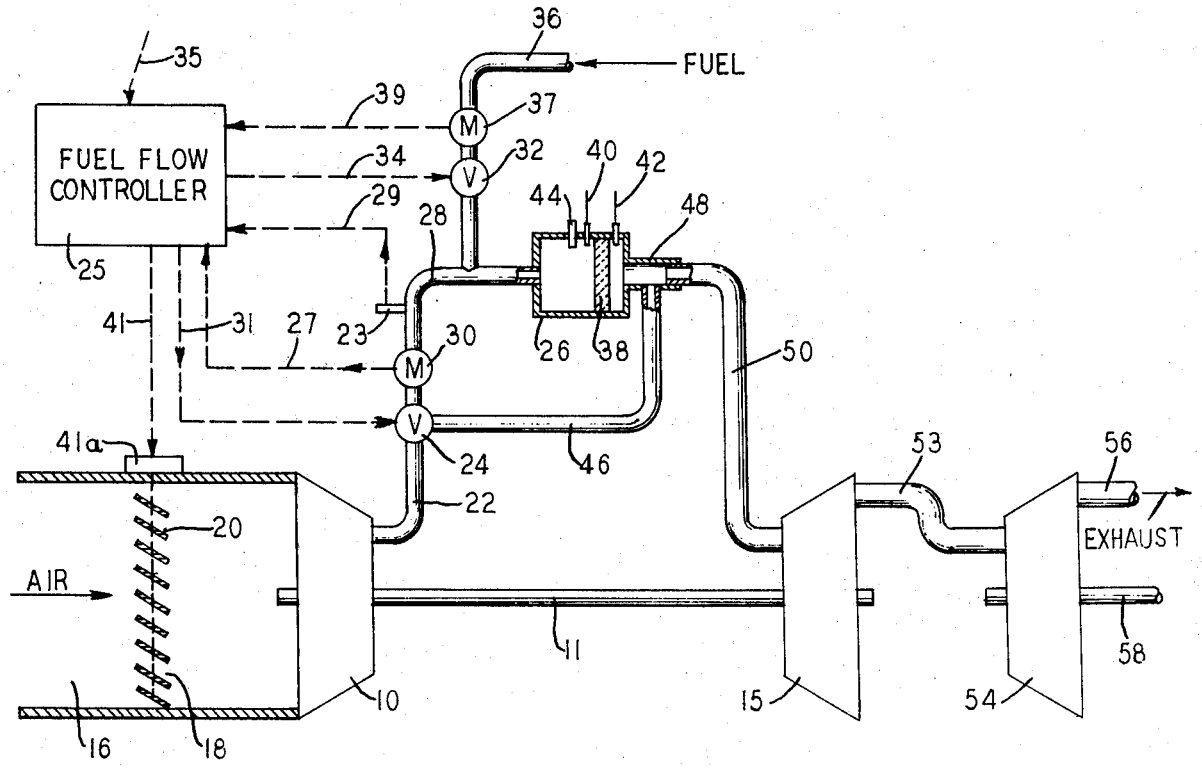
Figure 3:
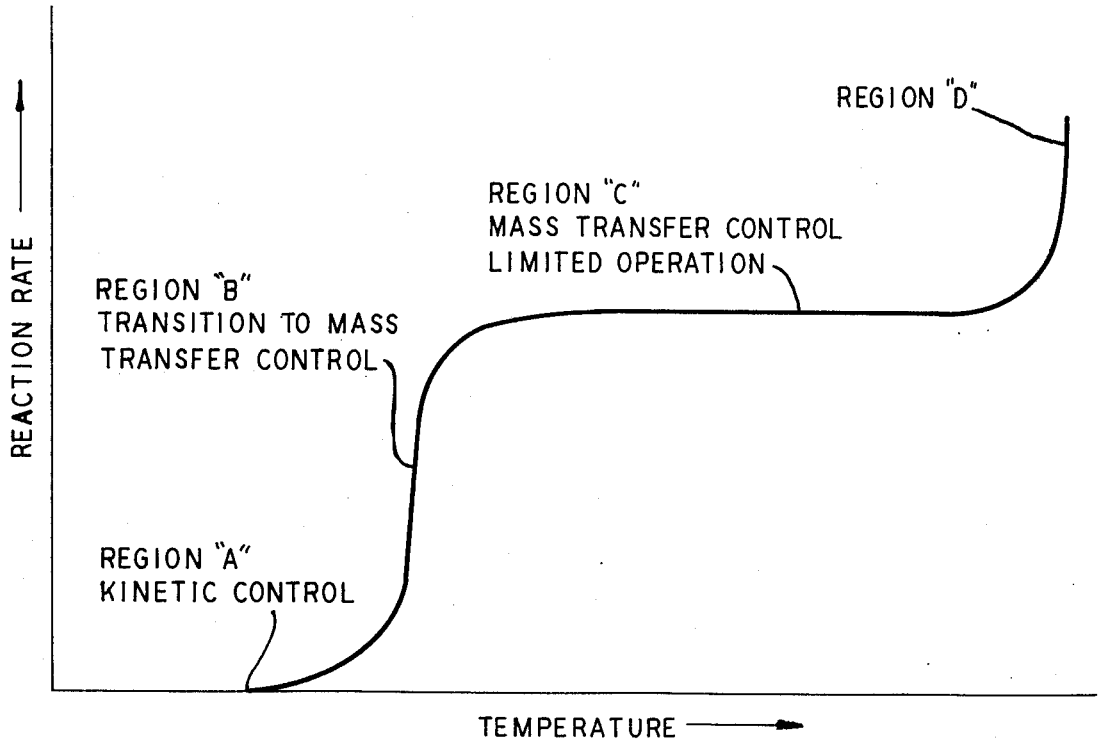
Figure 4:
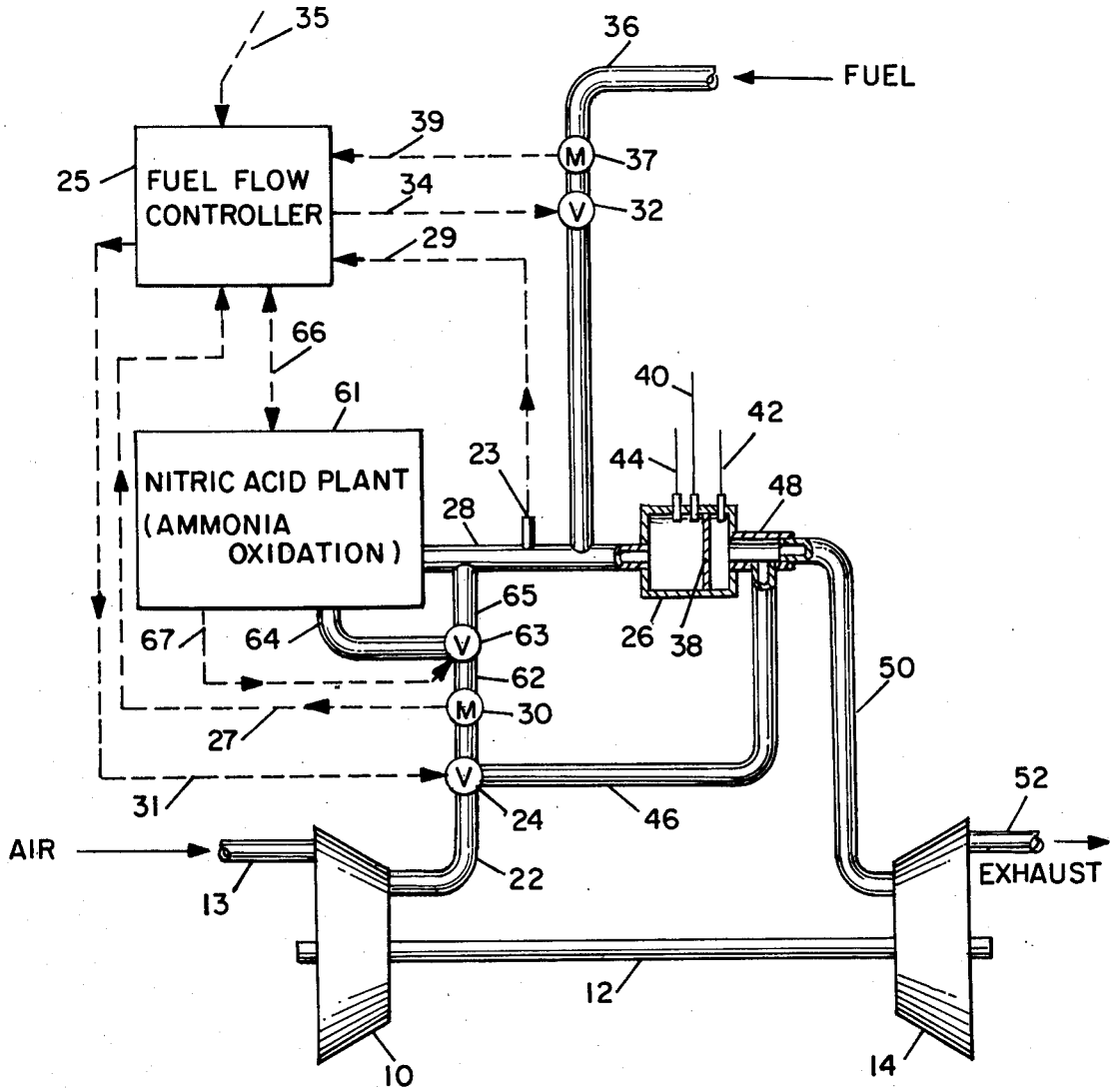

The turbine system of the present invention will be further described in connection with the drawings in which:

FIG. 1 is a schematic diagram illustrating the method and apparatus of this invention in an embodiment having a compressor 10 and catalyst-containing combustor 26 and a turbine 14;

FIG. 2 is a schematic diagram illustrating the method and apparatus of this invention in an embodiment having a compressor 10, combustor 26, a free turbine 15, and a power turbine 54;

FIG. 3 is, as described above, a graph of combustion reaction rate as a function of temperature for combustion in the presence of a solid oxidation catalyst; and FIG. 4 is a schematic diagram illustrating the method and apparatus of this invention in an embodiment utilizing a catalyst to combust fuel, with combustion air supplied in the form of tail gas from a chemical plant, illustrated as a plant for ammonia oxidation to produce nitric acid.

With reference to FIG. 1, the air compressor 10 is driven by a rotatable power shaft 12 which is propelled by turbine 14. The shaft 12 can be connected to any suitable power transmission system to use the power imparted to the shaft 12 by the turbine 14. Thus turbine 14 may be employed to operate an electrical generator, or an automotive vehicle through an automatic transmission. The turbine system including turbine 14 and compressor 10 may, for example, be a high compression turbine having a compression ratio of 10:1. Turbines generally have compression ratios of at least about 2:1 and typically at least about 5:1 causing combustion to occur at elevated pressures relative to ambient pressure. The compression ratios referred to are the approximate number of atmospheres under which combustion takes place. Automotive vehicles will generally have a turbine with a compression ratio of about 5:1 indicating that combustion at the rated speed takes place at about 75 psia when ambient air is at about one atmosphere. The structure, operation, and control of turbines are known in the art, details in this regard will be omitted from this description since they are unnecessary to explain the present invention.

Intake air is admitted to intake line 13 and is compressed in the air compressor 10. The compressed air passes through line 22 to air portioning valve 24 where the air is divided into one portion to be admixed with the fuel and a second portion to be combined with the combustion effluent.

The portion of the compressed air to be admixed with the fuel passes from air portioning valve 24 through line 28 on which are located orifice meter 30 and thermocouple 23. The air is passed through orifice meter 30, into contact with thermocouple 23, mixed with fuel and then passed to combustor 26. The orifice meter 30 measures the volume and the thermocouple 23 measures the temperature of air passing through line 28. The amount of fuel entering the turbine system through fuel line 36 is measured by fuel flow meter 37 located thereon. This amount is regulated by the fuel supply control valve 32 which is located on line 36. A fuel flow controller 25 is provided to respond to power requirements through demand input means 35 which demand means 35 is in turn responsive to a source not shown such as manual control or a governor or the like. The controller 25 is operative on fuel supply control valve 32 and air portioning valve 24 through output linkages 34 and 31 respectively. The controller 25 in addition to being responsive to demand input means 35 is also responsive to volume measurement signals from meters 30 and 37 and temperature measurement signals from thermocouple 23, through input linkages 27, 39, and 29 respectively. Thus, the relative amount of air passing through air portioning valve 24 into line 28 to the amount of fuel passing through fuel supply control valve 32 to be admixed with such air in line 28 is controlled to maintain a relatively constant adiabatic flame temperature in combustor 26.

Since the fuel-air mixture is in or passed through the inflammable range, a gas velocity above the flame propagating velocity of the particular fuel-air mixture at the conditions of the inlet of the catalyst is used to insure against flaming and possible detonations. The fuel-air admixture charged to the combustor 26 at this velocity is therein contacted with the catalyst 38. A thermocouple 40 is positioned upstream from the catalyst to measure the temperature of the combustor at this location. A theromcouple 42 is located downstream from the catalyst 38 to determine the temperature of the effluent gases.

During start-up of the combustion system, fuel and air can be introduced into the combustor 26 in an amount regulated by air portioning valve 24 and fuel supply control valve 32 to provide an inflammable mixture at a velocity below the maximum flame propagation velocity at the conditions of start-up. The fuel-air admixture can be ingited by ignitor 44 and burned under flaming conditions until the catalyst 38 is at a temperature sufficient to initiate combustion when ignitor 44 is shut down. In order to protect the catalyst 38 from excesssively high temperatures the ignitor 44 and the point at which the fuel-air admixture from line 28 enters the combustor 26 can be positioned by simple mechanical alteration of the combustor so that the flame from the combustion of the fuel does not directly impinge on the catalyst 38. When operation of the catalyst has been established, the ignitor 44 can be incapacitated and valves 24 and 32 adjusted to a normal controlled temperature operating position which will extinguish the flame since the velocity of the fuel-air mixture at or upstream from the catalyst inlet will be above the maximum flame propagating velocity of the mixture at the conditions of the mixture.

The second portion of the compressed air from the air portioning valve 24 is passed through line 46 to a secondary zone or mixing chamber 48 which is adjacent to the outlet of the combustor 26. In mixing chamber 48, the second portion of air or additional air is combined with the effluent gases passing from combustor 26 to provide a cooler motive fluid for operating the turbine 14. The combined gases then pass through line 50 to the turbine 14 wherein they are employed to power the turbine 14 and impart rotary motion to shaft 12. The exhaust from the turbine 14 is released from the system through line 52.

An operational change in the turbine system as depicted in FIG. 1 can be effected in the following manner. For example, if an increase in turbine power output is desired, the demand input means 35 is adjusted to require such increase from controller 25. In response to controller 25, fuel-regulating valve 32 will increase the amount of fuel and air portioning valve 24 will increase the amount of air in the proper proportion to maintain a constant adiabatic flame temperature of the mixture passing to combustor 26. The controller 25 monitors the process to maintain a relatively constant adiabatic flame temperature of the mixture, in response to signals from meters 30 and 37 and thermocouple 23. Therefore, the fuel-air mixture is combusted and exits the combustor 26 at approximately the same temperature as the exhibited by the combustion effluent prior to the change in the conditions of the system.

Since a greater portion of the air charged to the combustion system has been directed by valve 24 to pass through line 28 to the combustor 26, a correspondingly lesser amount of the air passes via line 46 to be admixed with the combustor effluent in mixing chamber 48. The combined gases passing by line 50 to the turbine 14 are necessarily at a higher temperature due to the increased mass of the combustor effluent and the decreased mass of additional air. Thus the heat content of the motive gases to the turbine 14 is increased, allowing an increased power output yet maintaining an approximately constant temperature in combustor 26.

FIG. 2 depicts another embodiment of the turbine system of the present invention which is particularly adaptable for use in automobiles in which considerable periods of operating time are spent idling or undergoing speed changes. The turbine system of FIG. 2 is similar in nature to the system of FIG. 1 and the same members are designated by like numbers in each. In the system of FIG. 2, however, the intake air enters the turbine system through air inlet 16. An air flow regulation valve 18 comprised of adjustable louvers 20 is located within the air inlet 16 to control the amount of air passing to the turbine system. Valve 18 is responsively connected to input power demand 35 either directly not shown or through regulator 41*a*, linkage 41, and controller 25, as shown. The system operates in the same manner as that of FIG. 1 except that the additional variable of total air flow control is introduced. The air after passing through air inlet 16 and air flow regulation valve 18 passes to the compressor 10 and is compressed for use in the system as previously described. The effluent from the system, after being combined with the additional air in the secondary zone or mixing chamber 48, is used to power the free turbine 15 which in turn drives air compressor 10 via shaft 11. The free turbine 15 can be maintained at a constant speed, if desired, by utilization of a governor, for example, a device to change the pitch and/or opening of the turbine nozzles. The exhaust from free turbine 15 is passed through line 53 and introduced into power turbine 54 which drives power shaft 58. Power shaft 58 can be connected to any suitable power transmission system to utilize the power imparted to the shaft 58 by turbine 54.

The combined gases thus enter free turbine 15 at the desired temperature, and free turbine 15 draws sufficient energy from the gases to power air compressor 10. The exhaust of free turbine 15 is used as the motive fluid for power turbine 54. When the turbine system is at idle, the air intake control valve 18 is nearly closed, i.e., louvers 20 are nearly in a shut position. The power utilized by the operation of the free turbine 15 leaves the motive fluid with insufficient power to run the power turbine 54. As the air intake control valve 18 is opened, a greater amount of air enters the system. The air portioning valve 24 allows a proportionately larger amount of air to pass the combustor 26. The controller 25 monitors meters 30 and 37 and thermocouple 23 to maintain a constant adiabatic flame temperature of the fuel-air admixture.

The turbine control system of FIG. 2 can be used with the single shaft turbine of FIG. 1 as well as other turbines, similarly the system of FIG. 1 can be used with the free trubine design of FIG. 2

FIG. 4 illustrates an embodiment of the turbine system of the invention in which the catalyst operates conventionally at temperatures which need not exceed the instantaneous auto-ignition temperature of the combustion mixture. The turbine system of FIG. 4 is generally similar to that of FIG. 1 and the same members are designated by like numbers in each. In this embodiment a nitric acid plant 61, in which oxidation of ammonia to NO occurs catalytically followed by further oxidation to $NO_2$ and ultimately to nitric acid, provides oxygen-containing tail gas to the catalytic combustor 26. This tail gas contains recoverable heat values from the ammonia oxidation as well as compression energy supplied by compressor 10. In the system represented in FIG. 4, at least a portion of the compressed air leaves the separating valve 24 for passage through line 62 to splitter valve 63. The major portion of this air then passes through line 64 to the nitric acid plant 61 for utilization therein. Tail gas from plant 61 enters line 28, where it is admixed with fuel in controlled amounts from line 36 for passage to the combustor 26. The tail gas contains about 2–3% oxygen and serves as combustion air.

A line 65 is available when desired to by-pass controllable small proportions of compressed air from splitter valve 63 around plant 61 to avoid flow surges in the plant.

The catalyst for these examples typically can be made by slurrying 2400 grams of activated alumina powder, less than 40 mesh in size, in a mixer with a solution prepared by dissolving 2526 grams $Cr(NO_3)_3 \cdot 9H_2O$ and 1382 grams $Ce(NO_3)_3 \cdot 6H_2O$ in 890 ml. $H_2O$. The mixture is dried at 120°C. over a weekend. The dried solids are crushed and screened to less than 40 mesh, and then the powder is calcined for 4 hours at 1000°C. 3200 grams of the powder is charged to a 3.5 gallon ball mill along with 3200 ml. $H_2O$ and 145.4 grams of palladium nitrate. The mill is rolled for 17 hours at 54 RPM. The resulting slip has a density of 1.63 grams per ml., a pH of 4.20 and a viscosity of 12 centipoises. 1625 grams of the as-recovered slip are diluted with 1180 ml. of a 1 percent nitric acid solution. The zircon millite honeycomb is dipped in the diluted slip and held for one minute, and then withdrawn from the slip and blown with air to remove excess slip. The coated honeycomb is dried for 16 hours at 110°C. and then calcined for 2 hours at 500°C. The honeycomb is cooled, and shows a pickup of 11.0 weight percent slip or coating.

The upstream or initial catalyst in the combustor for EXAMPLES 1 and 2 has a catalytic coating of 13.9 weight percent of the catalyst. This coating is 70 weight percent alumina, 14 weight percent $Cr_2O_3$ and 16 weight percent $CeO_2$ based on these components. The catalyst also contains 0.23 weight percent palladium (calculated) disposed in the coating. The subsequent-in-line catalyst has a similar coating of alumina, ceria and chromia which is 11.0 weight percent of the catalyst. This catalyst contains 0.18 weight percent palladium (calculated) disposed in the coating.

EXAMPLE 1

A turbine is operated in accordance with the turbine system schematically depicted in FIG. 1. Air is passed into the system at the rate of about 0.8 pound per second and compressed. The compressed air is preheated to about 600°F. Approximately 0.4 pound per second of the compressed air is admixed with sufficient naphtha so that the mixture will exhibit a theoretical adiabatic flame temperature of about 2300°F.

The fuel-air mixture is combusted, using a catalyst of 1.0 weight percent platinum and 10.0 weight percent activated alumina supported on a honeycomb cordierite support, the active alumina having a surface are of about 150 square meters per gram and the honeycomb being 2 inches in thickness. The efffluent from the combustion zone is at a temperature of about 2200°F. The effluent is combined with 0.4 pound per second of the preheated additional air and the temperature of the motive fluid to the turbine is 1400°F. The turbine is at idle with a motive fluid at this temperature. An operational change in the turbine system is introduced by passing 0.6 pound per second of air to be admixed with the fuel. The combustion effluent is still at a temperature of 2200°F. Additional air in the amount of 0.2 pound per second in combined with the combustion effluent to produce a turbine motive fluid at a temperature of about 1800°F which is sufficient to increase turbine power.

EXAMPLE 2

Commercial unleaded gasoline is utilized in a turbine operated in accordance with the turbine system of this invention schematically depicted in FIG. 2. The fuel rate is 67 pounds per hour and the amount of combustion air is controlled at 2150 pounds per hour by means of the air flow control valve 18. The nominal velocity of the compressed air is 40 feet per second. The combustor inlet temperature of the fuel-air mixture is 690°F, the combustion temperature in the neighborhood of the catalyst is 2400°F, and the amount of dilution air is such as to produce a temperature of 1700°F in the combined effluent. The combined effluent from the dilution zone is allowed to expand in a turbine to produce rotating motion and exhausted through a test chamber to determine pollutant content. It is found that the effluent is low in pollutants. Power is increased by adjusting the air flow control valve to increase air flow to 6000 pounds per hour; fuel flow increases proportionally to 186 pounds per hour to maintain combustion zone temperature constant. The ratio of dilution air to combustion air is held constant as are the combustor outlet and dilution zone effluent temperatures. The effluent is again low in pollutants.

EXAMPLE 3

Unleaded commercial gasoline is utilized in a turbine in a manner identical with that of EXAMPLE 2 except that the air separating means is adjustable. The fuel rate is 115 pounds per hour and the amount of combustion air is 4000 pounds per hour delivered at a nominal air velocity of 35 feet per second at the combustor inlet. The temperature of the fuel-air mixture at the inlet to the combustor is 810°F. The temperature in the combustion zone is 2450°F, and sufficient dilution Two-way linkage 66 is provided between fuel flow controller 25 and the plant 61, whereby the controller 25 is responsive to flow changes within the plant and the plant instrumentation also is responsive to power demand changes, so that, by means of a linkage 67 from the plant to valve 63, the latter valve is adjusted to maintain the desired air flow to plant 61.

The following examples will more fully illustrate the embodiments of this invention, in particular the method of controlling the temperature in a combustion zone at an approximately constant value wherein the combustion zone employs combustion of carbonaceous fuels by contact with a catalyst in order to obtain an effluent containing very small amounts of hydrocarbons, carbon monoxide and nitrogen oxides. All proportions referred to herein and in the appended claims are by weight, unless otherwise indicated.

In these examples, the catalyst is of the monolithic, honeycomb-type having a nominal 6-inch diameter and is disposed within the combustion zone as two separate pieces each having parallel flow channels 2¼ inches in length extending therethrough. There is a small space of about ¼-inch between these pieces. Both pieces of catalyst have approximately 100 flow channels per square inch of cross-section with the walls of the channels having a thickness of 10 mils. The catalyst have similar compositions and are composed of a zircon mullite honeycomb support which carries a coating of alumina containing palladium, chromia, and ceria. air is added to the effluent from the combustor to produce a temperature of 2100°F. The combined effluent from the dilution zone is allowed to expand in a turbine to produce rotating motion and is then exhausted through a test chamber as in EXAMPLE 2. The power is decreased by reducing the total air flow to the compressor by means of the air flow controller to 3000 pounds per hour and the amount of air to the combustor in relation to the amount of air to the dilution zone is decreased to result in a dilution zone effluent temperature of 1900°F with the fuel flow adjusted to maintain the combustion zone temperature at 2450°F. Effluent pollutant levels are similar to those of EXAMPLE 2.

EXAMPLE 4

A 150 ton per day nitric acid plant powered by a gas turbine is operated in accordance with the turbine system of FIG. 4. Air enters the system at the rate of 20 pounds per second and is compressed to about ten atmospheres. About 85–95% of the air is passed to the nitric acid plant for utilization therein. Tail gas from the nitric acid plant passes to the catalytic combustion reactor operating under mass transfer limited conditions, and then to a turbine to produce the amount of power needed to run the plant. Fuel is added to the tail gas, and intimately admixed therewith prior to entering the catalytic reactor, in sufficient quantities to maintain a constant catalyst temperature of about 1400°F. The power output of the turbine is adjusted by controlling the amount of air which by-passes the catalytic reactor, thus varying the turbine inlet temperature. To permit rapid variations in power output without creating flow surges in the nitric acid system, the additional air required for power levels, beyond those obtainable from the nitric acid plant tail gas at the steady state operating conditions of the plant, may be fed to the catalytic reactor without passing through the nitric acid plant process equipment.

Conventional nitric acid plant catalytic systems typically provide only 80% of the plant power requirements because of the inherent inability to handle varying loads. This stems from the large mass of the catalyst required and the consequent high thermal inertia to changes in temperature of such a large mass of catalyst. Consequently, the turbine inlet temperaure and therefore the turbine power output level cannot be changed rapidly enough to handle typical load fluctuation. By contrast, the system of this example provides additional power for use elsewhere. Catalytic reactor volumetric space velocities in the range of 30,000 to 200,000 volumes per volume per hour may be used.

What is claimed is:

1. A method for operating a gas turbine by combusting a carbonaceous fuel over a period of operation of said turbine during which the fuel demand or the combustion air temperature varies, comprising:

a. forming an intimate admixture of said fuel and combustion air;

b. substantially simultaneously controlling the ratio of said fuel to said combustion air in said admixture to maintain the adiabatic flame temperature of said admixture at about a preselected value;

c. combusting at least a portion of the fuel in said admixture under essentially adiabatic conditions in a combustion zone, in the presence of a solid oxidation catalyst occupying a major portion of the flow cross section of said combustion zone, to form an effluent of high thermal energy; and d. passing said effluent to a turbine to rotate said turbine.

2. The method as defined in claim 1, further comprising combining additional air with said effluent prior to passage thereof to said turbine.

3. The method as defined in claim 2 wherein the amount of said combustion air admixed with said fuel and the amount of additional air combined with said effluent are proportionately varied in an inverse manner whereby an increase in the amount of said combustion air admixed with said fuel results in a decrease in the amount of said additional air and an increase in the power output of said turbine.

4. The method as defined in claim 1, further comprising: disposing said catalyst in a combustion zone and passing said admixture to said combustion zone with a velocity at or upstream of said catalyst above the maximum flame propagating velocity of said admixture.

5. The method as defined in claim 1, further comprising: varying the amount of fuel in said admixture thereby varying the power output of said turbine in direct relation to the amount of said fuel.

6. A method for operating a gas turbine by combusting a carbonaceous fuel over a period of operation of said turbine during which the fuel demand or the combustion air temperature varies, comprising:

a. forming an intimate admixture of said fuel and combustion air;

b. substantially simultaneously controlling the ratio of said fuel to said combustion air in said admixture to maintain the adiabatic flame temperature of said admixture at about a preselected value;

c. combusting at least a portion of the fuel in said admixture under essentially adiabatic conditions in a combustion zone, in the presence of a solid oxidation catalyst occupying a major portion of the flow cross section of said combustion zone, to form an effluent of high thermal energy, said fuel-air admixture being formed and controlled to have an adiabatic flame temperature such that said cayalyst operates at a temperature substantially above the instantaneous auto-ignition temperature of said fuel-air admixture but below a temperature that would result in any substantial formation of oxides of nitrogen; and d. passing said effluent to a turbine to rotate said turbine.

7. The method as defined in claim 6 wherein additional air is combined with said effluent prior to passage thereof to said turbine, the amount of combustion air used in forming said admixture with the fuel and the amount of said additional air being varied in an inverse manner whereby an increase in the amount of said combustion air results in a decrease in the amount of said additional air and an increase in the power output of said turbine.

8. The method as defined in claim 6 wherein said admixture is formed and controlled to have an adiabatic flame temperature between about 1700° and about 3200°F.

9. The method as defined in claim 6, further comprising: varying the amount of fuel in said admixture thereby varying the power output of said turbine in direct relation to the amount of said fuel.

10. The method as defined in claim 6 wherein said admixture contains at least about 1.5 times the stoichiometric amount of oxygen required for complete combustion of said fuel to carbon dioxide and water.

11. A method for operating a gas turbine by combusting carbonaceous fuel over a period of operation of said turbine during which the fuel demand or the combustion air temperature varies, comprising:

a. forming an intimate admixture of said fuel and combustion air, said admixture containing at least about 1.5 times the stoichiometric amount of oxygen required for complete combustion of said fuel to carbon dioxide and water, and said admixture being in the inflammable range or on the fuel lean side outside of the inflammable range;

b. substantially simultaneously controlling the amounts of said fuel and said combustion air in said admixture in relation to each other and to the temperature of said air to maintain the adiabatic flame temperature of said admixture at about a preselected level;

c. passing said fuel-air admixture to a combustion zone, in which is disposed a solid oxidation catalyst occupying a major portion of the flow cross section of said combustion zone, with a velocity at or upstream of the inlet to said catalyst above the maximum flame propagating velocity of the admixture being so passed;

d. combusting at least a portion of the fuel in said admixture under essentially adiabatic conditions in the presence of said catalyst, the residence time of the admixture in said combustion zone being less than about 0.05 second, to form an effluent of high thermal energy and low atmospheric pollutant content, said fuel-air admixture being formed and controlled to have an adiabatic flame temperature such that said catalyst operates at a temperature substantially above the instantaneous auto-ignition temperature of said fuel-air admixture but below a temperature that would result in any substantial formation of oxides of nitrogen;

e. combining an amount of cooler, additional air with said effluent; and f. passing the combined gases to a turbine to rotate said turbine.

12. A method for operating a gas turbine by oxidizing carbonaceous fuel which when burned with a stoichiometric amount of air has a adiabatic flame temperature of at least about 3300°F, comprising admixing air with a sufficient amount of the fuel to maintain a fuel-air mixture having an approximately constant fuel-to-air ratio by volume; combusting the said fuel-air mixture in a combustion zone in the presence of a solid oxidation catalyst at a temperature in the range of about 1500° to about 3200°F to provide a combusted effluent, the mixture being combusted at an approximately constant temperature over a period of turbine operation in which the rate of charging fuel to the combustion zone is varied, and the velocity of the fuel-air mixture at or upstream of the inlet to the combustion zone being maintained above the maximum flame propagating velocity of the mixture; combining a sufficient amount of cooler, additional air with the combusted effluent to provide a combined gas wherein the temperature of the combined gas is essentially constant over a period of turbine operation in which the rate of charging fuel to the combustion zone is varied; and passing the combined gas to a turbine as a motive fluid.

13. The method of claim 12 wherein the combustion is at a temperature of about 1700° to about 3000°F.

14. A turbine system comprising;

a. a gas turbine;

b. an air compressor;

c. separating means, selectively capable of responding to power requirements of said turbine, for receiving compressed air from said compressor and selectively capable of separating said compressed air into at least a first portion and a second portion;

d. metering and temperature sensing means for measuring the flow rate and temperature of at least said first portion of compressed air, selectively operationally connected to said separating means;

e. fuel regulating and delivering means, responsive to power requirements of said turbine, communicating with said metering and temperature sensing means to deliver an amount of fuel necessary to provide a controlled ratio of fuel to at least said first portion of air;

f. a first mixing zone which receives at least said first portion of air and said fuel and provides an intimate admixture thereof;

g. a combustor having a catalyst disposed therein to receive and combust said intimate admixture from said first mixing zone to provide a combustion effluent of high themal energy;

h. a second mixing zone adapted to receive said combustion effluent and said second portion of compressed air, and capable of providing a second zone effluent in the form of a mixture of said combustion effluent and said second portion of compressed air; and i. means for supplying said second zone effluent to said turbine.

15. A turbine system comprising:

a. a gas turbine;

b. an air compressor;

c. intake air regulation means connected to the inlet of said air compressor and responsive to power requirements of said turbine to control the amount of air delivered to said compressor;

d. separating means, selectively capable of responding to power requirements of said turbine, for receiving compressed air from said compressor and selectively capable of separating said compressed air into at least a first portion and a second portion;

e. metering and temperature sensing means for measuring the flow rate and temperature of at least said first portion of compressed air, selectively operationally connected to said separating means;

f. fuel regulating and delivering means, responsive to power requirements of said turbine, communicating with said metering and temperature sensing means to deliver an amount of fuel necessary to provide a controlled ratio of fuel to at least said first portion of air;

g. a first mixing zone which receives at least said first portion of air and said fuel and provides an intimate admixture thereof;

h. a combustor having a catalyst disposed therein to receive and combust said intimate admixture from said first mixing zone to provide a combustion effluent of high thermal energy;

i. a second mixing zone adapted to receive said combustion effluent and said second portion of compressed air, and capable of providing a second zone effluent in the form of a mixture of said combustion effluent and said second portion of compressed air; and j. means for supplying said second zone effluent to said turbine.

16. A turbine system comprising:

a. a gas turbine;
b. an air compressor;
c. a mixing zone connected to said compressor for receiving air therefrom and for receiving fuel to provide an intimate admixture of the fuel and compressed air;
d. metering and temperature sensing means for measuring the flow rate and temperature of compressed air received by said mixing zone;
e. fuel regulating and delivering means, responsive to power requirements of said turbine, communicating with said metering and temperature sensing means to deliver to said mixing zone an amount of fuel necessary to provide a controlled ratio of fuel to said compressed air.
f. a combustor having an oxidation catalyst therein for receiving and combustion and intimate admixture from said mixing zone to provide a combustion effluent of high thermal energy; and
g. means for supplying said combustion effluent to said turbine.

17. The system as defined in claim 16, further comprising a heat exchanger connected between said air compressor and said mixing zone for effecting transfer of heat from the turbine exhaust gases to the compressed air.

18. A turbine system comprising:
a. an air compressor;
b. intake air regulation means connected to the air compressor for controlling the amount of air available to the air compressor;
c. means for receiving compressed air from said air compressor and separating said compressed air into a first portion and a second portion;
d. metering means operationally connected to the separating means to measure the flow rate of said first portion of compressed air;
e. fuel regulating means communicating with said metering means to supply an amount of fuel necessary to maintain about a constant volume ratio of said fuel to the first portion of compressed air;
f. a fuel mixing zone for receiving said first portion of compressed air and the fuel supplied by said regulating means;
g. a combustor having an oxidation catalyst therein which receives and combusts the fuel-air mixture from the fuel mixing zone;
h. a subsequent mixing zone which receives and combines combustor effluent and the second portion of compressed air;
i. a turbine; and
j. means for supplying the combined mixture from the subsequent mixing zone to the turbine.

19. A turbine system comprising:
a. a gas turbine;
b. means for mixing fuel with air and for compressing said fuel-containing air;
c. a combustor having an oxidation catalyst therein for receiving and combusting said fuel-containing air from said mixing and compressing means to provide a combustion effluent of high thermal energy;
d. metering and temperature sensing means for measuring the flow rate and temperature of the compressed fuel-containing air received by said combustor; and
e. fuel regulating and delivering means, responsive to power requirements of said turbine, communicating with said metering and temperature sensing means to deliver a said mixing and compressing means an amount of fuel necessary to provide a controlled ratio of fuel to air in said fuel-containing air.
f. means for supplying said combustion effluent to said turbine.

20. The system as defined in claim 19, further comprising a heat exchanger connected between said mixing and compressing means and said combustor for effecting transfer of heat from the turbine exhaust gases to the compressed fuel-containing air.

21. A system as defined in claim 15, wherein said separating means is in fixed position without operational adjustment connection to said sensing means.

* * * * *

UNITED STATES PATENT AND TRADEMARK OFFICE

CERTIFICATE OF CORRECTION

PATENT NO. : 3,975,900

DATED : August 24, 1976

INVENTOR(S) : William C. Pfefferle

It is certified that error appears in the above-identified patent and that said Letters Patent are hereby corrected as shown below:

Page containing the Abstract, at top of column 1 in the title, after "Temperature" insert --Control--.

Column 1, line 3, after "Temperature" insert --Control--.

Column 19, line 42, after "has" and before "adiabatic" delete "a" and insert --an--.

Column 21, line 18, after "receiving and" delete "combustion and" and insert --combusting said--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*